US005356141A

United States Patent [19]

Oursler et al.

[11] Patent Number: 5,356,141

[45] Date of Patent: Oct. 18, 1994

[54] ROULETTE SCORING DEVICE

[75] Inventors: Barry Oursler, Barrington; Zofia Bil; Python Anghelo, both of Chicago, all of Ill.

[73] Assignee: Williams Electronics Games, Inc., Chicago, Ill.

[21] Appl. No.: 151,546

[22] Filed: Nov. 12, 1993

[51] Int. Cl.[5] ..... A63F 7/30

[52] U.S. Cl. ..... 273/119 R; 273/119 A; 273/123 R; 273/123 A; 273/118 D; 273/127 R

[58] Field of Search ..... 273/118–124, 273/127 R

[56] References Cited

U.S. PATENT DOCUMENTS

| | | | |
|---|---|---|---|
| 2,019,150 | 10/1935 | Maitland | 273/121 A |
| 2,084,497 | 6/1937 | Maitland | 273/121 A |
| 2,240,276 | 4/1941 | Williams et al. | 273/119 A |
| 2,618,486 | 11/1952 | Durant | 273/124 A |
| 3,975,019 | 8/1976 | Barlow | 273/121 A |
| 5,120,059 | 6/1992 | Oursler | 273/120 A X |

*Primary Examiner*—Vincent Millin
*Assistant Examiner*—Raleigh W. Chiu
*Attorney, Agent, or Firm*—Rockey, Rifkin and Ryther

[57] ABSTRACT

The play feature for a pinball game of the present invention comprises a roulette scoring device mounted above the playfield which includes a horizontally rotating wheel having a plurality of apertures arrayed around its periphery. A different point value indicated to the player is associated with each of the apertures. Pinballs can enter the roulette scoring device not only from the shooter lane, but also from a ramp disposed on the playfield. An optical switch or microswitch included in the ramp adjacent a holding device and a microswitch in the shooter lane generate signals sent to the game microprocessor to cause the wheel to rotate. An optical switch mounted on the playfield senses the return of the ball to the playfield and signals the game microprocessor to stop the rotation of the wheel and to add the appropriate point value to the player's score.

13 Claims, 3 Drawing Sheets

ROULETTE SCORING DEVICE

BACKGROUND OF THE INVENTION

The present invention relates generally to pinball games and, more particularly, to an improved play feature for such games which is designed to foster and to maintain player interest in the games. A typical pinball game includes an inclined playfield which supports a rolling ball, a pair of flippers, a vertical backbox and a variety of play features. The person who plays the game controls flippers mounted on the playfield which, when activated by the player at the appropriate time, return the pinball back into play.

A typical object of pinball games is for the player to direct pinballs at selected play features or targets to score points. As a general rule, the more points that a player scores during a turn of pinball the more that player becomes intrigued with the game. Thus, it is desirable for pinball game manufacturers to design play features which provide entertaining effects and which stimulate player interest in the game by allowing for increased scores.

SUMMARY OF THE INVENTION

The play feature for a pinball game of the present invention comprises a roulette scoring device mounted on or above the playfield which includes a horizontally rotating wheel having a plurality of apertures with diameters greater than a pinball diameter arrayed around its periphery. The wheel rotates less than one pinball diameter above a plate having at least one exit hole to the playfield coaxial with the apertures. Pinballs can enter the roulette scoring device either from the shooter lane or from a ramp disposed on the playfield.

A microswitch or an optical switch located adjacent to a ramp containing a ball holding device and a microswitch in the shooter lane generate signals to cause the wheel to rotate. The player activates one of the flipper control switches to release the ball or activates the shooter to project the ball onto the wheel. A ball received in one of the rotating apertures is retained therein until the ball falls through an exit hole. An optical switch mounted on the playfield senses this and signals the game microprocessor to stop the rotation of the wheel. The apertures in the wheel preferably have different point values, thus the play feature is a skill shot.

DETAILED DESCRIPTION OF A PREFERRED EMBODIMENT

Figure 1:
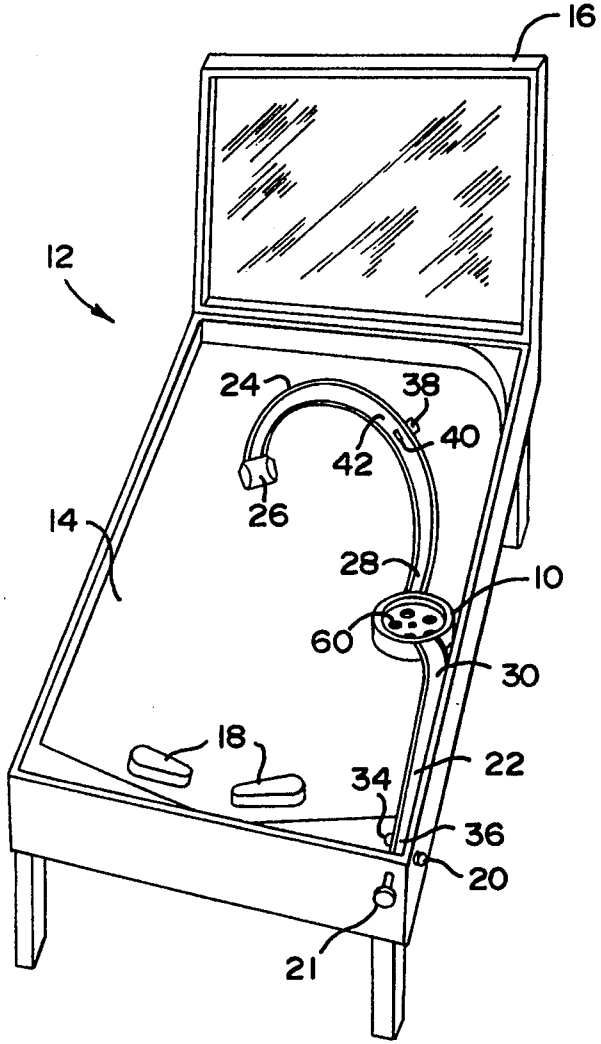
FIG. 1 is a perspective view of the play feature of the invention.

Referring to FIG. 1, a perspective view of the roulette scoring device 10 mounted on a pinball game 12 is illustrated. A typical pinball game 12 includes an inclined playfield 14, vertical back box 16, a pair of flippers 18, flipper control switches 20, shooter lane 22 (for introducing a ball onto the playfield) and a pinball. It must be noted, however, that in practice playfield 14 incorporates a number of playfield features. FIG. 1 shows only the roulette scoring device 10 for clarity.

Ramp 24 includes an entrance 26 which is disposed on the playfield 14 and an exit 28 which is oriented to allow balls to fall onto the roulette scoring device 10. Similarly, shooter lane 22 is provided with an exit 30 which is disposed above the roulette scoring device 10 such that pinballs that are propelled down the shooter lane 22 fall into the roulette scoring device 10.

Pinball game 12 includes a microprocessor unit (MPU) which typically is located in the back box 16. A motor 32 turns the rotary wheel 44 of roulette scoring device 10. The motor 32 and the flipper switches 20 are connected to the MPU through wiring which is located under the playfield 14. Typical pinball games also include a plunger 21 or solenoid kicker mechanism to propel pinballs down the shooter lane 22.

A microswitch 34 is operatively connected adjacent location 36 to generate a signal in response to the presence of a pinball. A player's turn is initiated when the player propels a pinball in location 36 down shooter lane 22. Playfield ramp 24 includes a gate 40 at location 42 which holds a pinball thereat when it has been shot onto the ramp 24. Optical switch or microswitch 38 is used to sense the presence of a pinball. Both the microswitch 34 and optical switch 38 are connected to the game microprocessor.

Figure 2:
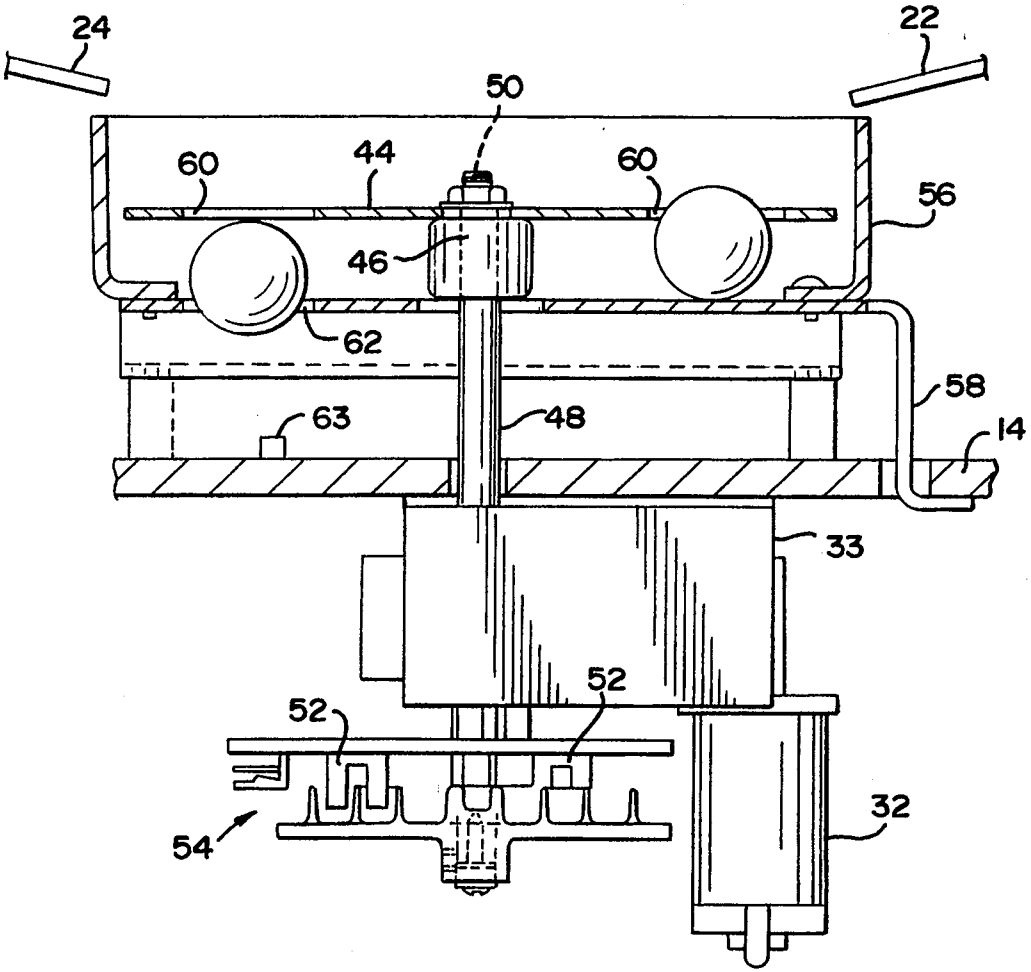
FIG. 2 is partial cross-sectional view of the play feature of the invention.
Figure 3:
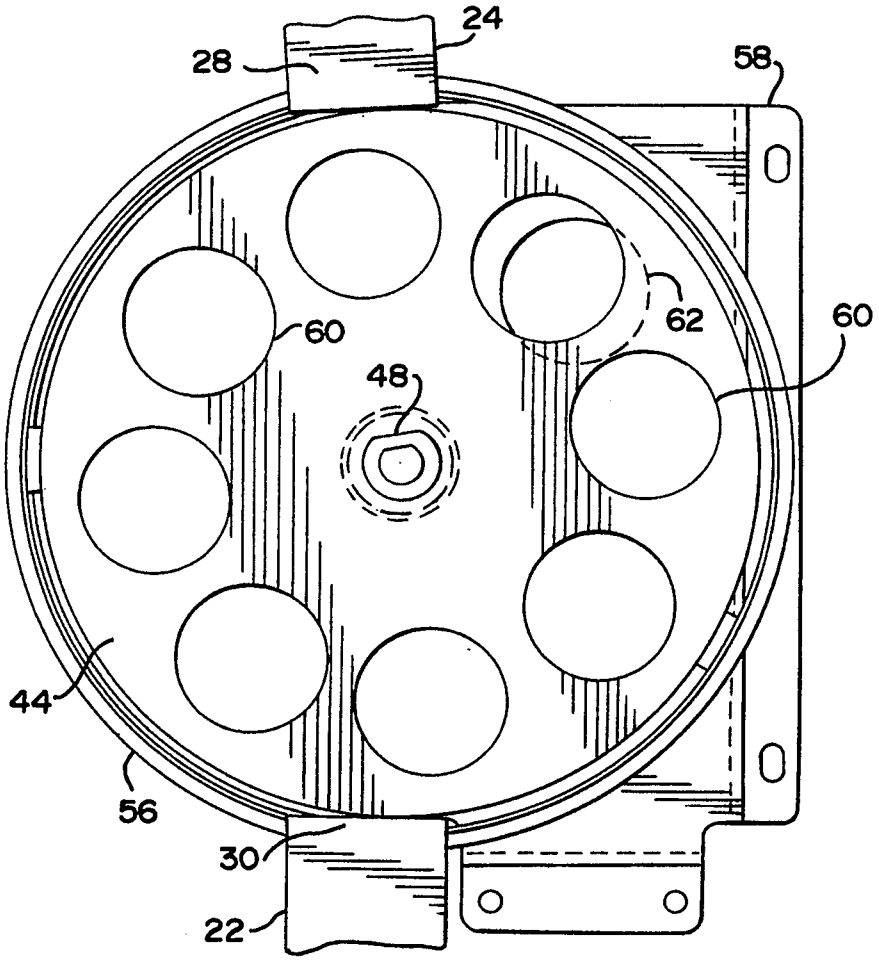
FIG. 3 is a top view of the play feature of the invention.

Referring to FIGS. 2 and 3, shooter lane 22 and playfield ramp 24 are oriented to allow pinballs to roll onto the rotating wheel 44 having a plurality of apertures 60. The wheel 44 rotates about vertical axis 50 of shaft 48 less than one pinball diameter away from a circular plate or plate 56 disposed therebelow. Plate 56 is stationery and secured to the playfield. The motion of shaft 48 is controlled by MPU operation of motor 32 via gear reducer 33. A pinball disposed in an aperture 60 revolves in the wheel 44 supported on plate 56 until it falls through exit aperture 62 in the plate (see FIG. 4).

An optical switch 52 and interrupter assembly 54 are provided on shaft 48 to generate signals (sent to the MPU) indicative of the relative rotational position of the wheel 44 when the ball drops through the exit aperture 62. Optical switch 52 remains fixed with respect to shaft 48 while the interrupter assembly 54 co-rotates therewith.

Figure 4:
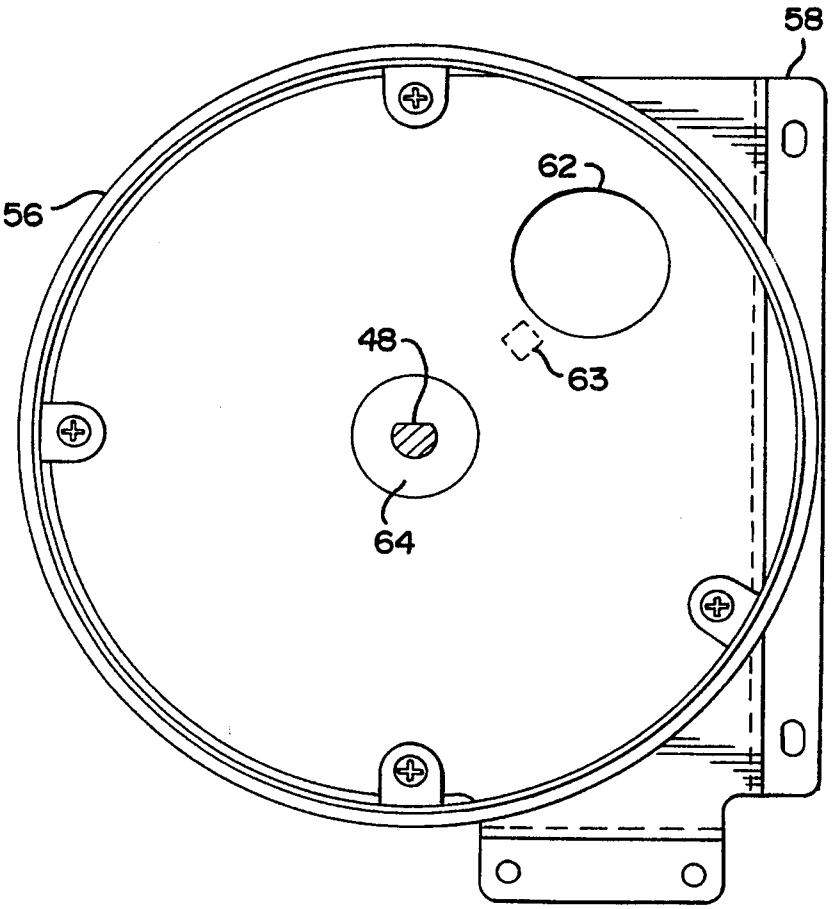
FIG. 4 is a top view of the plate and the exit hole through which balls fall to the playfield.

Referring to FIGS. 2 and 4, plate 56 is mounted to playfield 14 by means of the mounting bracket 58, and the wheel 44, hub 46 and the upper portion of shaft 48 rotate within the interior of plate 56. Wheel 44 includes a plurality of apertures 60, while plate 56 preferably includes only one exit aperture 62. All apertures have a diameter greater than the diameter of the pinball. The exit aperture 62 is substantially coaxial with the apertures 60 on the wheel. An optical switch 63 is mounted on the playfield to generate a signal to the MPU when a pinball falls through the aperture 62. Additional optical switches are provided on the playfield if additional exit aperture exist. As shown in FIG. 4, the plate 56 includes an aperture 64 through which the motor shaft extends. Mounting bracket 58 serves to connect the plate the playfield 14.

Figure 5:
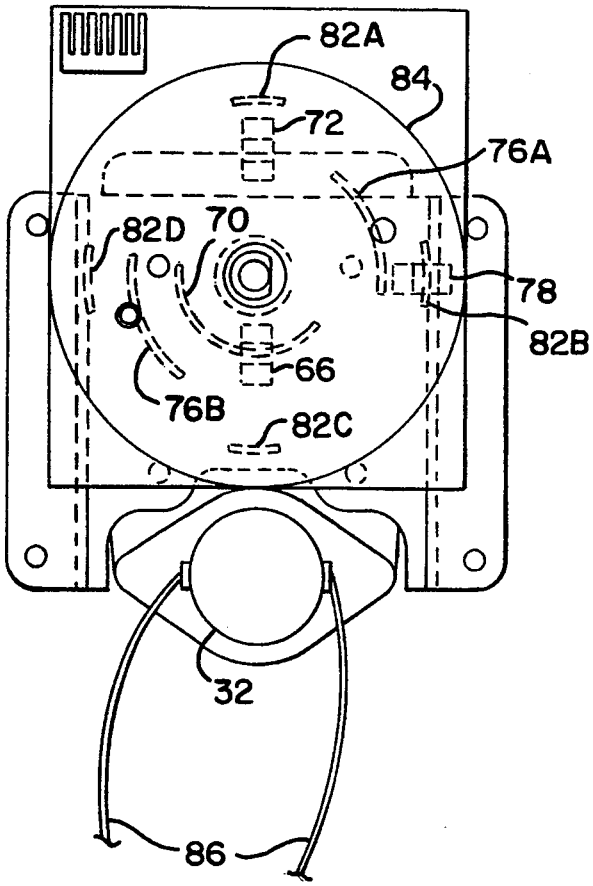
FIG. 5 is a bottom view showing the motor, optical switches and interrupter assemblies.

Referring to FIGS. 2 and 5, optical switch assembly 52 comprises a signal generator circuit 88 which is fixed with respect to shaft 48. Mounted thereon are optical switches 66, 72 and 78. The interrupter assembly 54 comprises a rotatable disk 84 which co-rotates with shaft 48. Disposed on the disk 84 are interrupters 70, 76 and 82. As the shaft 48 rotates, the interrupters produce three bit codes-identifying the current rotational position of the wheel.

The three bit signal is sent to the game microprocessor and is indicative of the orientation of the interrupters with respect to their corresponding optical switches. The number of positions registerable by the signals generated is at least as great as the number of apertures 60 in the wheel 44.

Different point values are associated with each one of the apertures 60 in wheel 44. Directing a ball into one of the apertures 60 is a skill shot which requires the player to time the release of a ball from location 36 or 42 to drop it into a particular aperture 60 having the greatest point value. The aperture containing the ball is identified by reading the shaft encoder signal when a ball is detected exiting through aperture 62.

Figure 6:
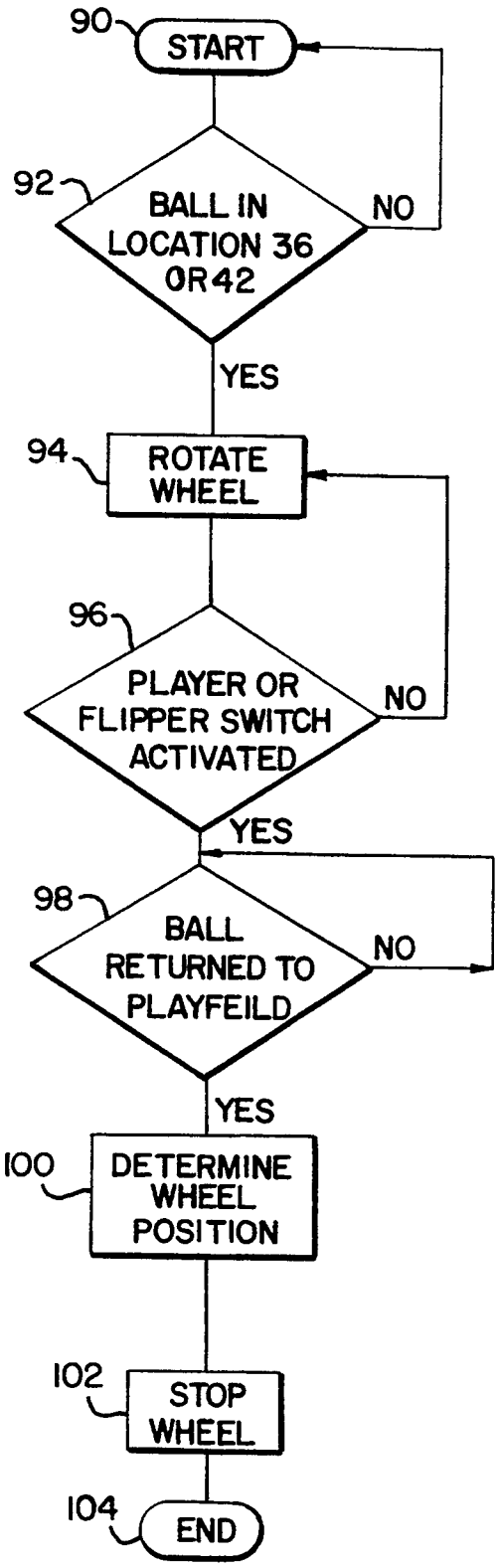
FIG. 6 is a flow diagram helpful in understanding the operation of the invention.

Referring to FIG. 6, a flow chart illustrates the operation of the roulette scoring device 10. Initially, the rotating wheel 44 is at rest with respect to the playfield 14. According to steps 92 and 94, when a ball is in location 36 or 42, microswitch 34 or 38 signals the MPU to turn on the motor 32 to rotate the wheel 44.

In step 96, the player activates the flipper switch 20 or the shooter 21 to project a ball held at location 36 or to release a ball held at location 42 respectively. The ball then falls onto the wheel and is deposited into one of the apertures. When a ball is returned to the playfield through exit hole 62 in step 98, optical switch 63 is closed which signals the MPU to determine the relative rotational position of the wheel in step 100, as represented by the three bit signal mentioned above. Comparison of the rotational position of the wheel to stored values in the same memory allows the MPU to add the score associated with the particular aperture 60 to the player's score.

When the ball is returned to the playfield, the optical switch 63 is closed which signals the microprocessor to turn off the motor 32 to stop the rotation of the wheel 44 in step 102.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A roulette type scoring device for use as a play feature in a pinball game having an inclined playfield supporting a rolling ball thereon comprising:

(a) a horizontally rotating wheel having a plurality of receiving apertures disposed therethrough, each aperture having a point value associated therewith and a diameter larger than the diameter of a pinball;

(b) means for rotating said wheel;

(c) means for delivering a ball to said wheel to permit it to be received in one of said apertures in said wheel;

(d) a horizontally disposed plate positioned beneath said wheel for supporting a ball delivered to said wheel thereon as said ball moves in one of said apertures, said plate having an exit opening therethrough to permit said ball to escape from the scoring device; and (e) means for determining which particular aperture has received said pinball, whereby the point value assigned to the particular aperture which received said ball can be added to the player's score.

2. The roulette scoring device of claim 1 wherein said means for delivering includes a shooter lane for putting a ball into play.

3. The roulette scoring device of claim 2 further comprising means for starting the wheel rotating when a ball is in the shooter lane and for stopping the wheel after the ball passes through said scoring device.

4. The roulette scoring device of claim 1 wherein said means for delivering includes a ramp for conveying a pinball to the scoring device.

5. The roulette scoring device of claim 4 further comprising:

a) means for holding the ball on the ramp until the player signals to release it to said scoring device;

b) means for starting the wheel rotating when said ball is held on said ramp; and c) means for stopping the wheel after the ball passes through said scoring device.

6. The roulette scoring device of claim 1 wherein said means for determining comprises an optical shaft encoder for determining the angular position of the wheel when a ball passes through said exit aperture thereby to determine which aperture in the wheel said ball was located.

7. A pinball game comprising an inclined playfield for supporting a rolling ball and a plurality of play features thereon, one of said play features including:

(a) a horizontally rotating wheel having a plurality of receiving apertures disposed therethrough, each aperture having a point value associated therewith and a diameter larger than the diameter of a pinball;

(b) means for rotating said wheel;

(c) means for delivering a ball to said wheel to permit it to be received in one of said apertures in said wheel;

(d) a horizontally disposed plate positioned beneath said wheel for supporting a ball delivered to said wheel thereon as said ball moves in one of said apertures, said plate having an exit opening therethrough to permit said ball to escape from the scoring device; and (e) means for determining which particular aperture has received the pinball, whereby the point value assigned to the particular aperture which received said ball can be added to the player's score.

8. The pinball game of claim 7 wherein said wheel is mounted flush with the playfield and said means for delivering includes a shooter lane and means for projecting a pinball therefrom whenever the player so desires.

9. The pinball game of claim 8 further comprising means for starting the wheel rotating when a ball is in the shooter lane and for stopping the wheel after the ball passes through said scoring device and returns to the playfield.

10. The pinball game of claim 8 wherein said means for delivering includes a ramp.

11. The pinball game of claim 10 further comprising:

a) means for holding the ball on the ramp until the player signals to release it to said scoring device;

b) means for starting the wheel rotating when said ball is held on said ramp; and c) means for stopping the wheel after the ball passes through said scoring device and returns to the playfield.

12. The pinball game of claim 7 wherein the wheel is disposed above the playfield and the pinball drops onto the playfield after passing through said scoring device.

13. The pinball game of claim 7 wherein said means for determining includes an optical shaft encoder for determining the angular position of the wheel when a ball passes through said exit aperture thereby to determine which aperture in the wheel said ball was located.

* * * * *